United States Patent [19]

Garcia

[11] Patent Number: 4,655,052

[45] Date of Patent: Apr. 7, 1987

[54] PORTABLE COOLER

[76] Inventor: Luciano F. Garcia, 34737 Knarr Rd., Yucaipa, Calif. 92399

[21] Appl. No.: 832,339

[22] Filed: Feb. 24, 1986

[51] Int. Cl.[4] ..... F25D 11/02

[52] U.S. Cl. ..... 62/441; 62/457; 62/458; 62/464; 62/465

[58] Field of Search ..... 62/457, 458, 441, 465, 62/464

[56] References Cited

U.S. PATENT DOCUMENTS

| | | | |
|---|---|---|---|
| 2,610,472 | 9/1952 | Maxwell | 62/457 X |
| 3,572,054 | 3/1971 | Curcio | 62/464 X |
| 4,286,440 | 9/1981 | Taylor | 62/457 |
| 4,499,998 | 2/1985 | Carlson | 62/457 X |
| 4,551,988 | 11/1985 | Petrantoni | 62/457 |

*Primary Examiner*—Lloyd L. King
*Attorney, Agent, or Firm*—Harvey S. Hertz

[57] ABSTRACT

A portable cooler includes a main cavity chest for storing foodstuffs and coolant. An auxiliary cavity is used to store beverages which can be consumed simultaneously while being cooled. A partition separates the main cavity and the auxiliary cavity for enabling cool air to be circulated from the main chamber to the auxiliary chamber while preventing items in the main chamber to enter the auxiliary chamber.

3 Claims, 3 Drawing Figures

PORTABLE COOLER

DESCRIPTION OF THE PRIOR ART (1) Field of the invention

The invention relates in general to portable coolers, and more particularly, to a cooler having and auxiliary cavity which stores beverages while simultaneously continuing to cool the beverage.

(2) Description of the prior art

Conventional portable coolers are well known and enables a person to travel, primarily in a motor vehicle to have access to food and beverages in the cooler. With the advent of high technology insulating materials, these coolers are made of relatively light weight material. Typically, the coolers can have partitions therein for separating various items of food, beverage or coolant.

In one form of prior art portable vehicle cooler, a main chest cavity provides coolant and a storage bin for food and beverages. External of the main cavity a recess portion enables beverage cans and other items to recessed for consumation while driving the vehicle. However, it has been found that the canned beverage in the recessed area warms to the temperature in the vehicle rather rapidly unless consumed rather rapidly.

Other known prior art includes U.S. Pat. Nos. 4,509,587; 3,974,658; 4,499,998; 3,605,435; 4,424,687; 2,706,895; 4,020,986; and 4,307,581.

SUMMARY OF THE INVENTION

A portable cooler includes a main chest cavity for storing foodstuff and coolant. An auxiliary cavity stores beverages which can be consumed while simultaneously being cooled. A partition separates the main cavity and the auxiliary cavity for enabling cool air to be circulated from the main cavity to the auxiliary cavity for preventing items in the main cavity from entering the auxiliary cavity.

The advantages of this invention, both as to its description and mode of operation, may best be understood by reference to the following detailed description taken in connection with the accompanying drawings in which like reference numerals designate like parts throughout the figures.

DESCRIPTION OF THE PREFERRED EMBODIMENT

Figure 1:
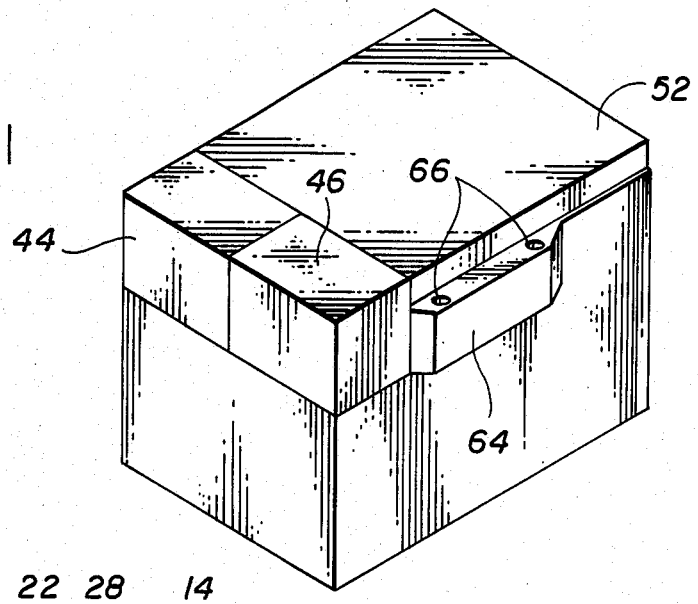
FIG. 1 is a perspective view illustrating the portable cooler of the present invention.
Figure 2:
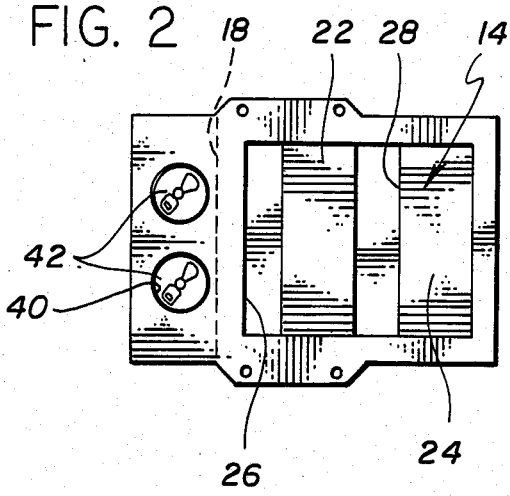
FIG. 2 is a top plan view of FIG. 1 with the covers removed of the cooler of FIG. 1.
Figure 3:
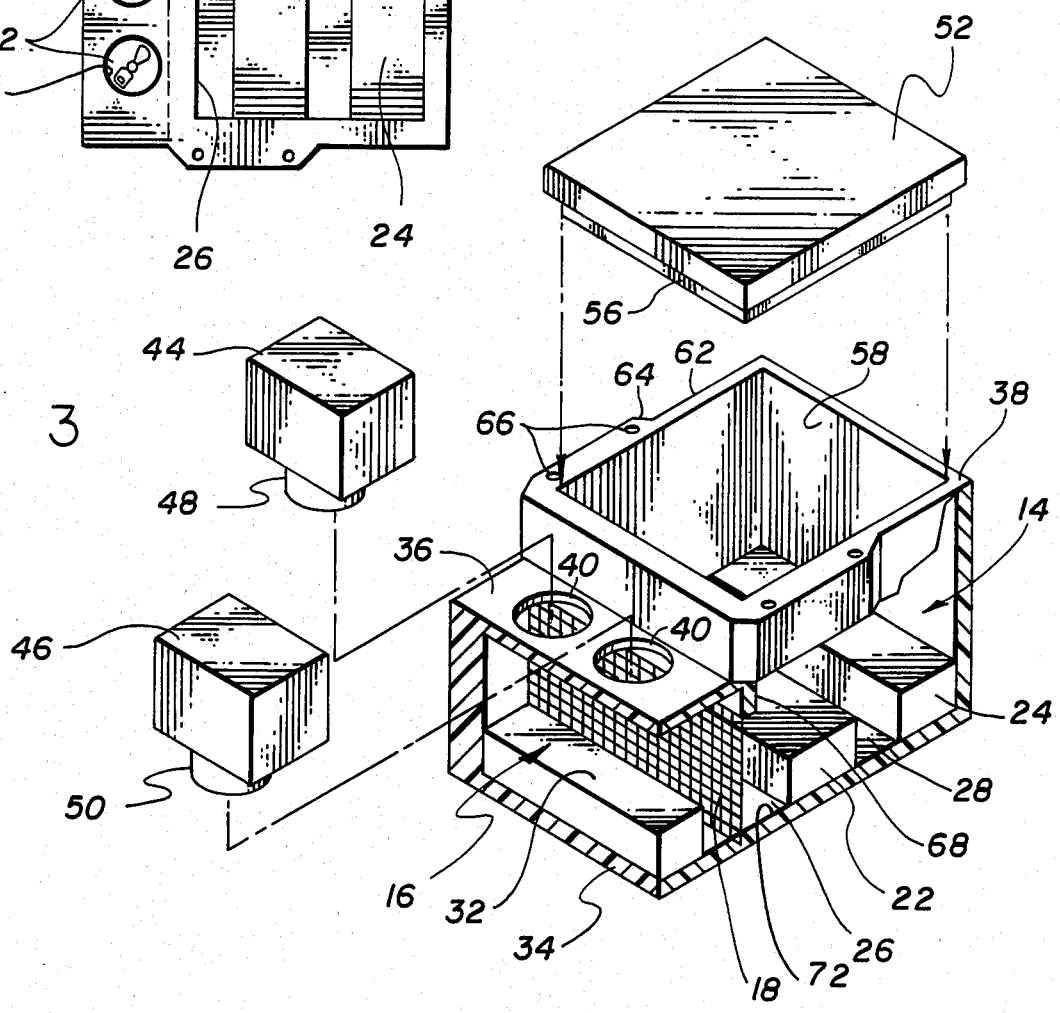
FIG. 3 is an exploded perspective view, partially cut away, of the cooler of FIG. 1.

Refering now to the drawings, there is shown in FIG. 1 a portable cooler constructed in accordance with principles of the invention. The portable cooler consists of a main cavity 14 where food, beverages, and coolant can be stored and an auxiliary cavity 16 where beverages can be temporarily stored while being consumed.

The main cavity 14 and the auxiliary cavity 16 are separated by a transversely extending partition 18. Typically, the partition is made of a mesh material which could be molded plastic or a metal, such as aluminum. In the main cavity 14, which is of cube-like configuration, a pair of transversely extending block members 22 and 24 have top surfaces which form a raised floor in the main cavity 14.

A first gap 26 is formed between partition 18 and the block member 22. Similarly, a second gap 28 is formed between the block members 22 and 24. Blocks of ice or "Blue ice" members can be positioned in these gaps and, simultaneoulsy, food and beverages can be placed on the top surface of the block members 24.

A third block member 32, parallel to and of similar configuration as the block members 22 and 24, is positioned in the auxiliary cavity 16. The block 32 normally rests against the front surface 34 of the cooler and is spaced from the partition 18 enabling cool air to flow from the main cavity 14 into the auxiliary cavity 16.

The top surface 36 of the auxiliary cavity 16 terminates a short distance below the top surface 38 of the main cavity. A pair of cylindrical openings 40 extend downwardly from the top surface 36 of the auxiliary cavity and enables beverage cans 42 to be inserted therein, which normally would rest on the top surface of the auxiliary cavity block 32. It should be noted that when the beverage can 42 is inserted into the opening 40, only a minimum amount of cool air will escape from the interior of the cooler due to the relatively close fit. In addition, the cool air which travels from the main cavity 14 into the auxiliary cavity 16 via the partition 18, enables the beverage cans 42 to remain relatively cool.

When beverage cans are not positioned in the cylindrical openings 40, a pair of auxiliary top block plates 44 and 46 are positioned on the top surface of the auxiliary cavity 36. Each of these plates 44 and 46 contain a plug 48 and 50, respectively, which inserts into the cylindrical opening 40 and forms a tight seal to prevent cool air escaping from the cooler.

The main cavity cover 52 is removable and is generally flush with the top surface 38 of the main cavity. A slight downwardly extending portrution 56 forms a tight seal with the interior surface 58 of the main cavity.

The outer side walls 62 of the beverage cooler contains a pair of outwardly portruding grips 64. These grips contain vertical openings 66 into which handles (not shown) can be inserted for carrying the beverage cooler.

The front wall 68 of the main cavity 14 terminates just below the top wall 36 of the auxiliary cavity. The partition 18 is typically connected between the bottom surface 72 of the cooler and the front wall 68. Normally, the partition 18 is secured or otherwise molded into the coolant walls. The partition 18, made of plastic or metal screening, enables the air to flow between the main cavity 16 and auxiliary cavity 16.

I claim:

1. A portable cooler comprising:

a main chest cavity for storing foodstuffs and coolant;

an auxiliary cavity for storing beverages which can be consumed while simultaneously being cooled; and a partition separating said main cavity and said auxiliary cavity having a plurality of apertures formed therein for enabling cool air to be circulated from said main cavity to said auxiliary cavity and preventing items in said main cavity from entering said auxiliary cavity, said main cavity having its own removable cover for enabling access therein, said auxiliary cavity containing openings for storing beverage cans therein with a relatively close fit; and plug members incorporated in said cooler for closing said openings to prevent cool air from escaping from said cavity where a beverage can is not positioned in said opening, said beverage cans when inserted in said openings allowing only minimal cool air to escape from the interior of said cooler, said beverage cans when in said openings being accessible from the exterior of said cooler.

2. A portable cooler in accordance with claim 1 wherein said partition is a mesh screen member.

3. A portable cooler in accordance with claim 1 wherein said auxiliary cavity opening is in air path communication with said main cavity via a path defined by said partition and said auxiliary cavity.

* * * * *